US007222796B2

(12) United States Patent
Taras

(10) Patent No.: US 7,222,796 B2
(45) Date of Patent: May 29, 2007

(54) MAGNETIC IDENTIFICATION CARD CLIP

(76) Inventor: Curt Michael Taras, 376 Coventry Cir., Folsom, CA (US) 95630

( * ) Notice: Subject to any disclaimer, the term of this patent is extended or adjusted under 35 U.S.C. 154(b) by 0 days.

(21) Appl. No.: 11/041,025

(22) Filed: Jan. 24, 2005

(65) Prior Publication Data

US 2005/0167485 A1 Aug. 4, 2005

Related U.S. Application Data

(60) Provisional application No. 60/539,151, filed on Jan. 27, 2004.

(51) Int. Cl.
*G06K 7/00* (2006.01)
*G06K 5/00* (2006.01)

(52) U.S. Cl. ..... 235/486; 235/380; 235/382

(58) Field of Classification Search ..... 235/486, 235/380, 382; 40/1.5, 124.01, 642.02, 661.02, 40/661.04, 662–666; 24/3.12
See application file for complete search history.

(56) References Cited

U.S. PATENT DOCUMENTS 6,006,455 A * 12/1999 Miller ..... 40/1.6
6,085,393 A * 7/2000 Tsui et al. ..... 24/3.12
6,170,088 B1 * 1/2001 Tate ..... 2/209.13
6,671,986 B2 * 1/2004 Reeves ..... 40/1.6
6,684,544 B1 * 2/2004 Buettell ..... 40/661.01

* cited by examiner

*Primary Examiner*—Daniel Stcyr
*Assistant Examiner*—April Taylor

(57) ABSTRACT

A clip that utilizes a magnet to attach identification cards to clothing. The clip includes a clasp, a hinged metal bendable strap, and a magnetic connector which together allow identification cards to be displayed anywhere on a garment without penetrating, clamping or biting the fabric. The invention is connected to an identification card by passing the card attachment clasp through a slotted hole cut in the card and snapping it closed. The clasp is attached to a bendable strap that ties the card to the magnetic connector. The hinged metal bendable strap can bend and flex allowing the position of displayed card to adjust to the movement of the person wearing it. The magnetic connector consists of two parts. The first part is a ferrous metal plate which is fixed to the back of the bendable strap. The second part is an extra strong magnet which is placed behind clothing fabric when attaching the invention to a person's clothing. Using magnetic attraction, the two pieces of the connector hold together and sandwich clothing fabric between them. This attaches the invention and an identification card to the blank face of a garment without penetrating, clamping, or biting the fabric.

9 Claims, 2 Drawing Sheets

MAGNETIC IDENTIFICATION CARD CLIP

BACKGROUND OF THE INVENTION

This invention relates to a magnetic clip used to attach items to garments, and more specifically to a magnetic clip for attaching an identification card to clothing for display.

Identification cards are increasingly required to be displayed on clothing for security and occupational related purposes. Employers and government agencies have policies that require the wearing of a photo ID to control access to secure areas and aid in employee identification. Due to these policies and security procedures there is a need for identification card display devices that are easy to use, compact, and functional. One of the primary functions of such a device is to position the ID card in a visible location on a person in close relation to their face. This positioning is important so an effective ID check can be made. The ideal location for this is on or near the chest. Another function of identification card display devices is to show the official logo and/or name of the employer so that employees can be identified as being affiliated as part of an organization. Just like a uniform identifies employees, these devices display the logo and/or name of the organization so that employees can be distinguished from the public.

Currently available devices to perform this task include clips, pins, adhesive, and lanyards, all which have limitations. Clips which utilize a biting pair of spring loaded teeth called an alligator clip, need a bite of clothing such as a pocket flap or lapel to attach to and cannot attach to the featureless blank face of a blouse or sweater. This prevents the ID card from being located on or near the chest when a breast pocket is not available to attach to. The ID is then sometimes clipped to a belt or a pants pocket which is often out of view making effective recognition of the face to the photo difficult. On garments such as a dress or a sweater there may be no flaps of clothing to attach to. This renders the alligator style clip ineffective for many types of garments.

Pins penetrate clothing and can damage fabric by leaving a hole. Pins are also troublesome to attach and remove from clothing while it is being worn. The garment must often be removed completely to position and secure the pin in the desired location. The clasp securing the sharp end of the pin does not lie flat. This produces an unsightly bump behind thin fabric and can be uncomfortable when worn against bare skin.

Adhesive backed identification tags are typically used for temporary identification. These adhesive backed tags are often disposable and have too weak of a bond to hold the common plastic photo ID card. The bond of adhesive only lasts for a few uses and progressively weakens each time.

Lanyards can carry plastic photo ID cards with ease but they can be unfashionable and a distraction to wear. The ID card ends up positioned near the waist or belly, not in the ideal position up near the breast. Lanyards also do not look attractive on finely tailored business attire. Instead of complementing the appearance of a garment, lanyards tend to overpower it. This is especially true when a lanyard is worn with a tie. Lanyards can also be uncomfortable and distracting because they hang from the neck, dangle in the way of tasks, and can get caught in equipment.

Due to the limitations of these devices there is a need for a new and innovative identification clip that can be attached directly to the surface of clothing like an adhesive badge but is durable and heavy duty like a clip or lanyard. This need is fulfilled by the invention detailed in the following summary.

SUMMARY OF THE INVENTION

This invention is a magnetic clip for attaching identification cards to clothing. In the preferred embodiment the invention is comprised of three major parts: a bendable hanger strap, a card attachment clasp, and a magnetic connector. The bendable strap acts as the linkage between the card attachment clasp and the magnetic connector and is constructed of hinged metal links. The strap functions as a bendable link between the clasp and the connector. At one end of the bendable strap is a card attachment clasp. The card attachment clasp securely connects an identification card or card sleeve to the bendable strap. In the preferred embodiment of the invention a foldover clasp is used for this function. Fixed at the other end of the bendable strap is the first (fixed) piece of a two-part magnetic connector which is a ferrous metal plate. On the opposite side of the ferrous metal plate is a surface to which a logo emblem can be displayed. The second (free) piece of the two part magnetic connector is a high strength magnet which can be detached from the invention and placed behind clothing.

The operation of the invention is very simple. To connect the invention to an identification card the clasp is threaded through a slot in the ID card or sleeve and snapped closed. To attach the invention to clothing, the free piece of the magnetic connector is placed inside a garment. The invention, with the fixed piece of the magnetic connector, is placed on the outside of the garment. Through magnetic attraction, the two pieces bind together sandwiching the clothing fabric between them. This attaches the invention and an identification card to the blank face of a garment without penetrating or biting the fabric.

The new invention described by this patent is an enhancement over existing devices because it has several distinct advantages. One advantage is this invention provides unlimited attachment possibilities. The invention can be attached anywhere on a garment and is not limited to being attached to pockets or lapels. This allows photo identification cards to be positioned in the ideal location near the chest for quick comparisons of the photo to the face. The procedure for attaching the invention to a garment is similar to placing a magnet on a refrigerator. A second advantage is the invention is self straightening. The invention hangs an ID card on the person much like a closet hanger hangs a garment. The single magnetic connector acts as a pivot point in conjunction with the bendable strap to allow the weight of the ID to self correct alignment. The combined features of the magnetic pivot point and the bendable strap allow minor movements of the assembly but keep the ID card secure and close to the wearer. A third advantage of the invention is logo display. This invention provides a surface for the display of a logo emblem on its front face. The functions of a logo pin are combined with the utility of a identification card clip to further enhance the appearance and recognition of employees and others wearing ID cards.

DETAILED DESCRIPTION OF THE DRAWINGS

Figure 1:
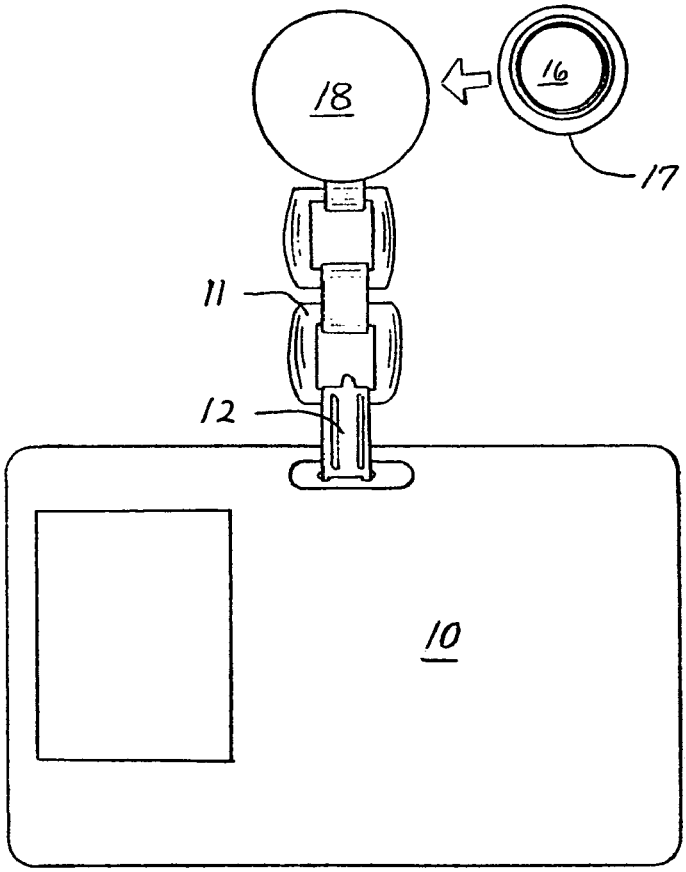
FIG. 1 is a front view of the magnetic identification card clip in a version that utilizes a metal link bendable strap.
Figure 2:
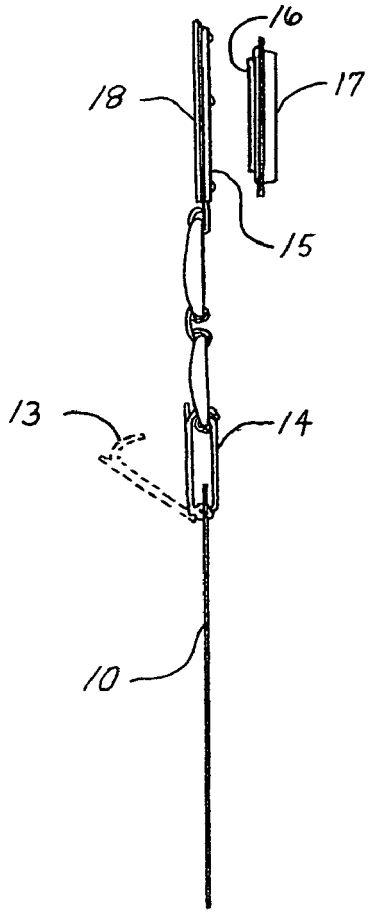
FIG. 2 is a side view of the magnetic identification card clip in a version that utilizes a metal link bendable strap.

Referring now to the drawings for a more detailed description of the invention, components are identified by numbers which are the same throughout the several views. FIGS. 1 and 2 illustrate the metal embodiment of the invention connected to an identification card 10. In this embodiment a linked metal bendable strap 11 is comprised of hinged metal links connected to one another like a chain. The bendable strap links the card attachment clasp 12 to the ferrous metal plate 13 of the two part magnetic connector. The bendable strap 11 can articulate to accommodate multiple changes of position and angle of the magnetic clip assembly 17. The card attachment clasp 12 in the metal embodiment is a modified foldover clasp which is a clasp design used in bracelets and watch bands. To attach the invention to an identification card 10 the toothed arm of the card attachment clasp 12 is threaded through a slot cut in the identification card 10. This is shown by the dashed alternative position of the clasp's toothed arm. The toothed arm is then folded closed until the tooth engages and snaps shut. At the opposite end of the bendable strap 11 is a ferrous metal plate 13 the first part of the two-part magnetic connector. The ferrous metal plate 13 is fixed to the back side of the bendable strap 11. The ferrous metal plate is in the shape of a disc. It is sized and positioned appropriately to receive the magnet 14. The magnet is the second piece of the two-part magnetic connector. The magnet rests in a magnet holder 15 which assists in prying and removing the magnet 14 when it is attached to the ferrous metal plate 13. The magnet 14 and holder 15 is a free component that can be removed and attached to the magnetic clip assembly 17 as required. On the front of the magnetic clip assembly 17, just opposite the ferrous metal plate 13 is a surface for the display of a logo emblem 16. The logo emblem 16 is fixed can be in the shape of a disc slightly larger than the ferrous metal plate. The logo emblem 16 can also be a customized shape to best display the logo image. Together these components make up the invention titled magnetic identification card clip.

Figure 3:
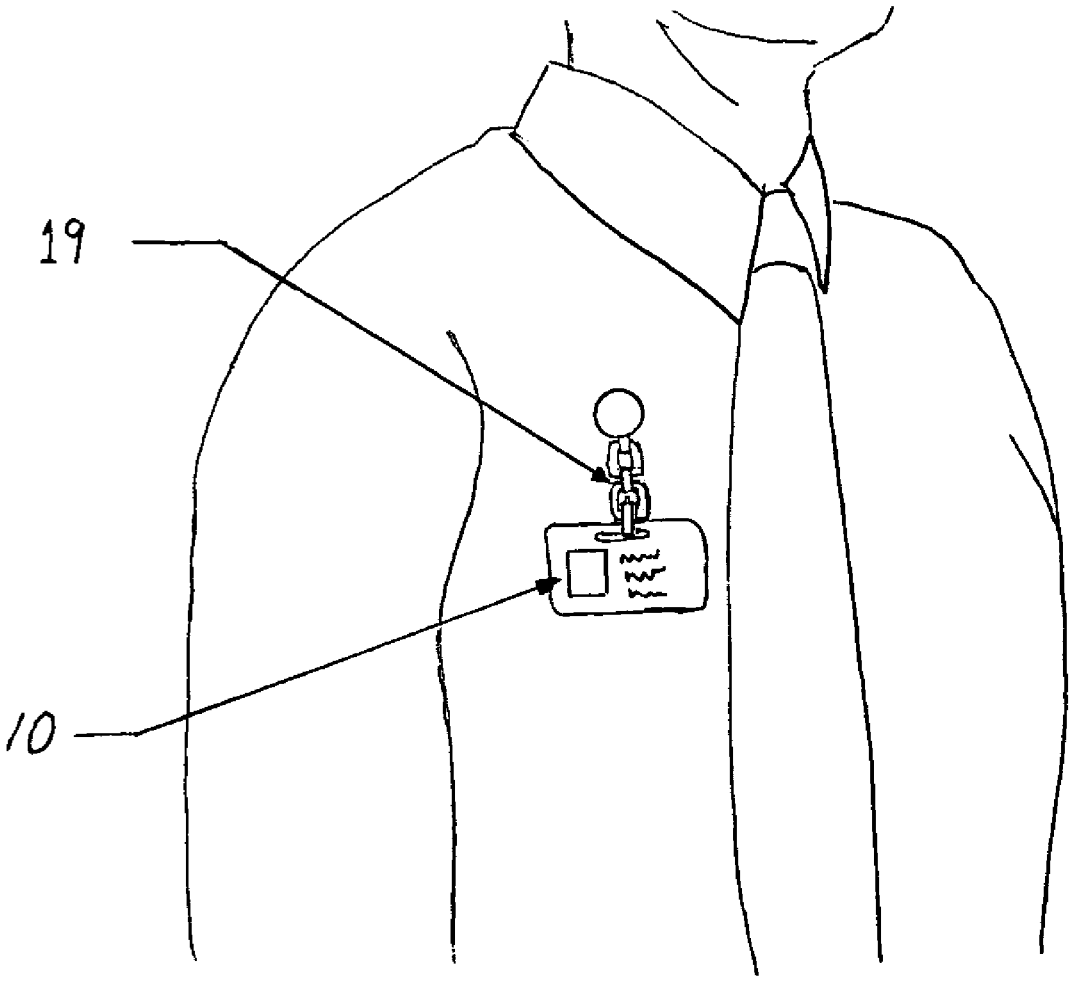
FIG. 3 illustrates the use of the invention for attaching an identification card to a worn garment

FIG. 3 illustrates the invention attached to a shirt on a person. To attach the invention to a garment the magnet 14 is placed inside the garment behind the fabric. The invention assembly 19 with the ferrous metal plate 13 is placed on the outside of the garment. The ferrous metal plate 13 is aligned with the magnet 14 at the desired attachment location on the garment. Through magnetic attraction, the magnet 14 and the ferrous metal plate 13 bind together sandwiching the clothing fabric between them. This attaches the invention assembly 19 and an identification card 10 to the blank face of a garment without penetrating or biting the fabric. Attached in this way, the identification card 10 hangs from the garment, dangling from the bendable strap 11 which allows minor position changes of the card.

While the invention has been described in detail with reference to preferred embodiments thereof, it will become apparent to those skilled in the art, other embodiments that are within the principle of the invention. The following claims are, therefore, intended to cover and embrace any modifications that remain within the true spirit and scope of the invention.

What is claimed is:

1. A clip for attaching identification cards to clothing comprising:

a. a metal link bendable strap, with first and second ends, b. a card attachment clasp that is fixed to said first end of said metal link bendable strap and is passed through a slotted hole cut in an identification card and snapped closed thereby attaching the identification card to said metal link bendable strap, c. a ferrous metal plate that is fixed to said second end of said metal link bendable strap with one side serving as one part of a two part magnetic connector, d. a high strength magnet that is free to be placed behind clothing fabric and binds to the said ferrous metal plate through the forces of magnetic attraction.

2. The clip of claim 1 wherein said card attachment clasp is a fold-over clasp.

3. The clip of claim 1 further comprising a surface to display logo emblems in combination with attaching identification cards to clothing.

4. The clip of claim 3 where the surface to display logo emblems is located on the ferrous metal plate.

5. The clip of claim 1 wherein said card attachment clasp is a two piece button style snap.

6. A method of attaching a card to clothing fabric comprising:

a. connecting a card to a metal link bendable strap by threading a clasp through a slotted hole cut in the card, b. snapping the clasp closed and hanging the card from said metal link bendable strap which is fixed to a ferrous metal plate, c. placing a magnet behind clothing fabric and allowing the magnet to bind to the ferrous metal plate with a layer of the clothing fabric captured between the magnet and the plate.

7. The method of claim 6 wherein said card is an identification card.

8. The method of claim 6 wherein a custom logo emblem is displayed on the ferrous metal plate for additional visual identification verification.

9. The method of claim 6 wherein a logo emblem is displayed on the ferrous metal plate for an advertising purpose.

* * * * *